US006035583A

United States Patent [19]

Papke

[11] Patent Number: 6,035,583

[45] Date of Patent: Mar. 14, 2000

[54] EXTRUDED BUILDING AND METHOD AND APPARATUS RELATED TO SAME

[76] Inventor: William R. Papke, 2645 Lake Edge La., NE., Grand Rapids, Mich. 49505

[21] Appl. No.: 08/934,377

[22] Filed: Sep. 19, 1997

Related U.S. Application Data

[60] Continuation-in-part of application No. 08/677,321, Jul. 2, 1996, abandoned, which is a division of application No. 08/187,635, Jan. 26, 1994, abandoned.

[51] Int. Cl.[7] ..... E04B 1/348; E04C 2/34

[52] U.S. Cl. ..... 52/79.1; 52/268; 52/269; 52/270; 52/284; 52/309.11

[58] Field of Search ..... 52/79.1, 265, 267, 52/268, 269, 270, 284, 309.9, 309.11

[56] References Cited

U.S. PATENT DOCUMENTS

| | | | |
|---|---|---|---|
| 1,750,491 | 3/1930 | Putnam . | |
| 1,783,120 | 11/1930 | Harrer . | |
| 2,061,633 | 11/1936 | Muller . | |
| 2,125,136 | 7/1938 | Trojanowski . | |
| 2,160,132 | 5/1939 | Durst . | |
| 2,165,116 | 7/1939 | Trojanowski . | |
| 2,275,572 | 3/1942 | Somers . | |
| 2,691,291 | 10/1954 | Henderson . | |
| 2,811,850 | 11/1957 | Clary . | |
| 2,863,606 | 12/1958 | Tatsch . | |
| 2,980,972 | 4/1961 | Kloote et al. . | |
| 2,990,588 | 7/1961 | McKinley . | |
| 3,066,770 | 12/1962 | Millard et al. . | |
| 3,201,907 | 8/1965 | Henderson . | |
| 3,236,254 | 2/1966 | Venuti . | |
| 3,354,947 | 11/1967 | McKinnon . | |
| 3,451,639 | 6/1969 | Atwood et al. . | |
| 3,462,897 | 8/1969 | Weinrott | 52/265 |
| 3,492,767 | 2/1970 | Pincus . | |
| 3,500,596 | 3/1970 | Anderson . | |
| 3,624,977 | 12/1971 | Morton et al. . | |
| 3,669,585 | 6/1972 | Krupp . | |
| 3,687,168 | 8/1972 | Sherman et al. . | |
| 3,707,165 | 12/1972 | Stahl . | |

(List continued on next page.)

FOREIGN PATENT DOCUMENTS

| | | | |
|---|---|---|---|
| 945323 | 4/1974 | Canada . | |
| 1002385 | 3/1952 | France . | |
| 2552194 | 5/1977 | Germany | 52/309.11 |

OTHER PUBLICATIONS

Exhibit A is an article entitled *I Buy From Someone Else, I Got No Edge*, dated Dec. 20, 1993.

Exhibit B is a brochure entitled *The Future is Now*, published by The Royal Plastic Group, Weston, Ontario, Canada, copyright 1992, disclosing a modular housing wall system.

*Primary Examiner*—Michael Safavi

*Attorney, Agent, or Firm*—Price Heneveld Cooper Dewitt & Litton

[57] ABSTRACT

A building structure includes a one-piece extruded and cut-to-length structure including integral sidewalls, a roof, and a floor. The sidewalls, roof, and floor are configured to simulate conventional wood frame construction (both in color and surface texture), and include various flanges and integral members to facilitate transport of the building structure, attachment of the building structure to a foundation, and assembly of secondary parts to the building structure. Extruded end walls and intermediate walls are configured to mate with the main extrusion for tight and quick assembly thereto. The wall construction includes a beam-like laminate of outer and inner layers of structure polymer bonded together with rigid foam. An extruded garage and extruded breezeway can be attached to the building structure to form a building having the appearance of a conventional ranch style wood frame residential building.

16 Claims, 14 Drawing Sheets

U.S. PATENT DOCUMENTS

| | | | |
|---|---|---|---|
| 3,769,766 | 11/1973 | Speidel . | |
| 3,778,528 | 12/1973 | Heifetz et al. . | |
| 3,783,563 | 1/1974 | Moore | 52/284 |
| 3,820,299 | 6/1974 | Verholt . | |
| 3,905,167 | 9/1975 | Watkins et al. . | |
| 3,922,128 | 11/1975 | Solomon . | |
| 3,923,436 | 12/1975 | Lewis . | |
| 3,994,105 | 11/1976 | Jamison et al. | 52/267 |
| 3,994,243 | 11/1976 | Anders . | |
| 4,115,962 | 9/1978 | Caisley . | |
| 4,118,905 | 10/1978 | Shelley . | |
| 4,226,580 | 10/1980 | Lupke et al. . | |
| 4,275,533 | 6/1981 | Wright . | |
| 4,276,730 | 7/1981 | Lewis . | |
| 4,290,248 | 9/1981 | Kemerer et al. . | |
| 4,299,069 | 11/1981 | Neumann . | |
| 4,327,529 | 5/1982 | Bigelow, Jr. et al. . | |
| 4,367,190 | 1/1983 | Beach . | |
| 4,373,304 | 2/1983 | Howitt . | |
| 4,462,778 | 7/1984 | Calcagni . | |
| 4,481,701 | 11/1984 | Hewitt . | |
| 4,527,370 | 7/1985 | Schuette | 52/309.9 |
| 4,628,650 | 12/1986 | Parker . | |
| 4,759,158 | 7/1988 | Aubry . | |
| 4,800,696 | 1/1989 | Miller et al. . | |
| 4,837,991 | 6/1989 | Shaw . | |
| 4,896,469 | 1/1990 | Wright . | |
| 5,036,638 | 8/1991 | Kurtz, Jr. . | |
| 5,181,353 | 1/1993 | Harrington, Jr. . | |
| 5,247,773 | 9/1993 | Weir | 52/309.9 |
| 5,274,972 | 1/1994 | Hansen . | |
| 5,344,700 | 9/1994 | McGath et al. . | |

344
333
334
332
330
343
335
330
XXXI
XXXI
IXXX
IXXX
335
341
339
333
334
332
338
331
339
330
337
336
330

EXTRUDED BUILDING AND METHOD AND APPARATUS RELATED TO SAME

CROSS REFERENCE TO RELATED APPLICATIONS

This is a continuation-in-part of application Ser. No. 08/677,321, filed Jul. 2, 1996, now abandoned which is a divisional of then application Ser. No. 08/187,635, filed Jan. 26, 1994 (now abandoned).

BACKGROUND OF THE INVENTION

The present invention generally concerns building structures, and more specifically concerns a building structure made from a large extrusion of polymeric material which facilitates manufacture of the building structure while advantageously maintaining the appearance of conventional wood frame residential housing. The present invention further concerns a method and apparatus for manufacturing the building structure.

A number of building structures have been proposed for making low cost affordable housing. However, the known low cost building structures usually look "low cost" and lack aesthetic appeal making them unattractive to tenants. The known building structures can be made more attractive by customizing the building structure on site; however, on-site customization is not "low cost" since it requires use of skilled labor on site. Also, additional features facilitating on-site construction and/or customization of the building structure are desired. At the same time, improvements yielding greater mass production efficiencies are desired.

Some low cost structures use cement as the load bearing structural material. For example, in U.S. Pat. No. 2,691,291 (to Henderson) there are disclosed multiple precast concrete segments that can be assembled to form a building structure. However, prefabricated cement segments are cast, which is a batch-type process requiring multiple forms and consuming considerable time while the cement cures. Further, the segments are solid concrete making them heavy even if they are only a few feet long. For example, Henderson discloses that the segments must be made relatively short in length to avoid segments that are "too large or unwieldy" (see Henderson, column 1, lines 13 and 14). It is noted that the short length makes the on-site assembly tedious since not only must multiple pieces be carefully aligned, but also equipment for manipulating the heavy segments must be present on site. Still further, concrete is not always the material of choice. For example, concrete is thermally conductive, and thus has a poor energy efficiency making it less desirable in cold climates. Still further, precast and uncovered concrete tends to have a cold, "uninviting" appearance that is very different from conventional wood frame residential housing. This often makes the buildings unacceptable to tenants, unless substantial work is performed on site to customize the building. However, the on-site customization is costly, as noted above. Additionally, it is noted that it is very difficult to make on-site modifications and/or customizations in the cement structure, such as the addition of windows or doors since the walls and roof are solid concrete.

In U.S. Pat. No. 3,923,436 (to Lewis), there is disclosed an elongated building structure manufactured on site from foamed-in-place material. The load bearing material of the building structure is the foamed-in-place material which must be made strong enough to withstand the stresses and abuse encountered by a typical building. Lewis notes that it may be desirable to increase the durability and toughness of the exterior skin of the foamed-in-place material, and for this purpose Lewis discloses that surfacing material may optionally be added to the inside and/or outside of the foamed-in-place material (see column 3, lines 18+). However, even with the addition of the surfacing material, the foamed-in-place material forms substantially the entire load bearing portion of the building structure. Lewis does not suggest constructing a load bearing wall section having structurally stiff layers at the inner and outer surfaces which, from an engineering standpoint, is where the load bearing structure is most needed. Further, in Lewis there are no flanges on the surfacing material that facilitate finishing the building structure, nor are there any features on the surfacing material or on the foam material of the wall that facilitate installation onto a foundation. Also, it is noted that the foamed structure in Lewis is substantially limited to on-site fabrication since the foam has a poor tensile strength and may crush or break if impacted or bent, such as often happens during shipping. However, on-site fabrication is expensive, difficult to control, and does not take maximum advantage of mass production. Still further, even with the addition of surfacing material to the foamed-in-place material in Lewis, the long term durability of the building walls is potentially not as good as desired.

In regard to the apparatus and method disclosed in Lewis, Lewis teaches use of a machine including a foaming device and adjustable forms which can be used on site. However, such equipment tends to be cumbersome to use, expensive to ship, and requires skilled labor to safely operate. Further, the apparatus requires use of hazardous materials on site, such as isocyanide material in the case of polyurethane foam. Still further, it is noted that the apparatus is not productive during transport or setup, and further is subject to vandalism while on site, thus making the overall cost higher than may initially be apparent. As a practical matter, it is noted that the sidewalls of a foam structure made by the Lewis machine may tend to bulge or wander as the structure is being formed or as the foam is curing, thus leading to later complaints from tenants about the building quality. This is a difficult problem since the building is constructed on site where there is less than optimal quality control. Lewis also suggests that the machine can be used to manufacture a building structure including a floor (column 6, lines 62+). However, any such floor structure would require continuous support until the floor cured to a self-supporting state, which would be a slow and tedious process for foamed-in-place material or cement, and thus which is not conducive to mass production.

It is noted that the Lewis patent also discloses that cement can be used instead of foamed-in-place materials; however, this produces a building structure having limitations not unlike those disclosed in Henderson, which were discussed above.

Thus, a building structure and method and apparatus for manufacturing same solving the aforementioned problems are desired.

SUMMARY OF THE INVENTION

In one aspect, the present invention includes a building structure comprising an elongated tubular extrusion including integral wall sections forming a floor, sidewalls, and a roof. The wall sections define an interior space large enough for a person to comfortably stand in, with the wall sections defining the floor and the sidewalls being generally planar and orthogonally related to each other, and further the wall sections defining the roof having an inclined surface so that the extrusion has the shape and appearance of a conventional wood frame residential building. The wall sections include at least one layer of non-foamed polymeric material forming a load bearing structural part of the wall sections.

In another aspect, the present invention includes a building structure comprising an elongated extrusion including integral wall sections forming sidewalls and a roof, the wall sections defining an interior space large enough for a person to stand in. The wall sections of a first layer and a second layer, the first layer being structural non-foamed polymeric material and the second layer being one of reinforcement webs integrally extending from the first layer and a slab of rigid foam bonded to the first layer. In one aspect, the wall sections comprise inner and outer layers of non-foamed structural polymeric material bonded to and spaced apart by an intermediate layer of foam material.

The preferred embodiments disclosed herein include several advantages over known prior art. The extruded building construction having a tubular shape has the rigidity, structure, and leak-proof shape of a tube. Further, the extruded wall sections have a high strength and durability due to the inner and outer layers of structural polymeric materials which are supported by an intermediate layer of rigid foam and/or reinforcement webs. Still further, the inner and outer layers can include multiple features "as-molded," such as molded-in color (including different colors between the sidewalls and the roof, and different colors between the inner and outer surfaces), different surface textures and patterns on all surfaces, molded-in mounting flanges and other flanges facilitating installation of secondary components, and properties of light weight and high strength-to-weight ratio facilitating shipment and on-site installation. Unlike other known products and processes, the present invention aims to provide a "user friendly" product which simulates conventional wood frame residential construction while simultaneously providing advantages of permanent color, moisture resistance, low air infiltration, high energy efficiency, and dramatically lower total cost after assembly and installation. Notably the extruded structure of the present invention can be extruded in any length desired, and the ends of the extruded structure can be cut to mate with other building structures. Further, the wall sections of the extruded home can be modified on site with conventional hand tools, such as with a skill saw or the like, yet are durable enough to withstand typical wear and tear on the exterior of a building. Still further, the low weight and high strength-to-weight ratio permit the extruded building structure to be manufactured at a central location for maximum mass production advantage, but permit the building structure to be readily shipped over roads and highways. Still further, the extruded home is compatible with a "computer integrated marketing and manufacturing process" in which a mass produced but customer tailored high quality building can be provided. For example, the computer integrated marketing and manufacturing process allows the customer's approved order to be transmitted by modem directly to the computer driven manufacturing processes and machinery. Notably, the extruded building unit itself is structurally whole eliminating the need for a structural frame (such as is required in mobile homes).

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
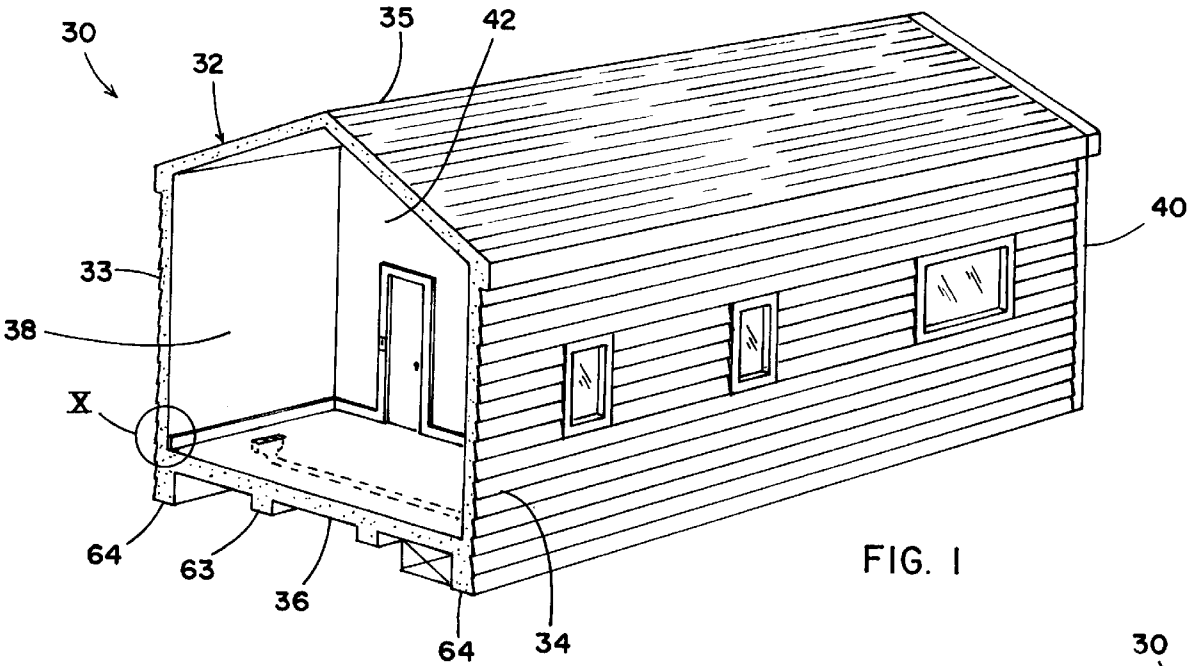
FIG. 1 is a perspective view of a building structure embodying the present invention, the building structure including a tubular extrusion with wall sections defining sidewalls, a roof, and a floor, and further including end walls (only one of which is shown) for closing the ends of the tubular extrusion, and an intermediate wall for subdividing interior space of the tubular extrusion.
Figure 2:
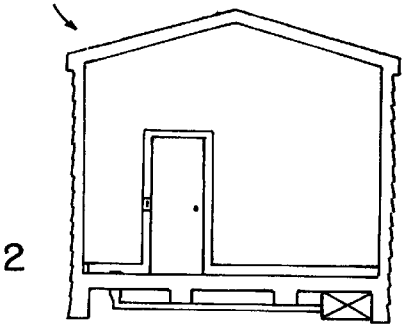
FIG. 2 is an end view of the building structure shown in FIG. 1.
Figure 3:
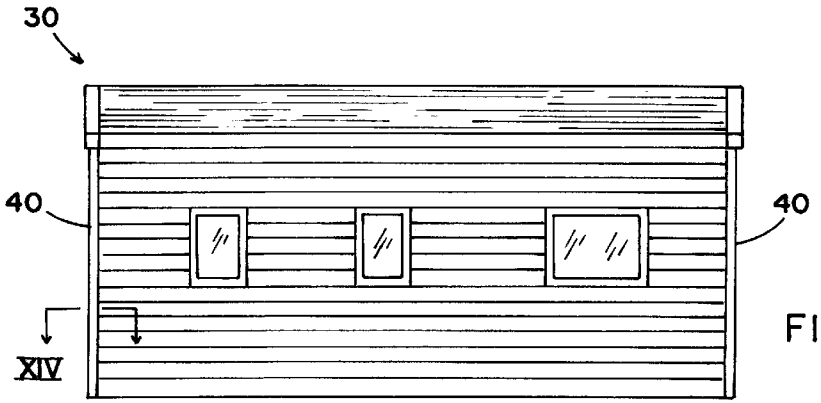
FIG. 3 is a side view of the building structure shown in FIG. 1 but including both end walls.

An extruded building structure 30 (FIGS. 1–4) embodying the present invention includes a one-piece extruded and cut-to-length extrusion 32 including integral sidewalls 33 and 34, a roof 35, and a floor 36 defining an interior space 38. The sidewalls 33 and 34, roof 35, and floor 36 include various flanges and other features to facilitate mass production and shipping of the building structure while minimizing or simplifying secondary operations such as attaching the building structure to a foundation and assembling fixtures and secondary parts such as baseboards to the building structure. The extrusion 32 is configured to simulate a quality conventional wood frame construction and allows a customer to select the size, shape, and color of various parts of the structure while maintaining advantages including permanent color, moisture resistance, low air infiltration, high energy efficiency, and dramatically lower total costs. Building structure 30 further includes a pair of end walls 40 and at least one intermediate wall 42 for engaging extrusion 32 to subdivide the interior space 38 within extrusion 32.

Figure 5:
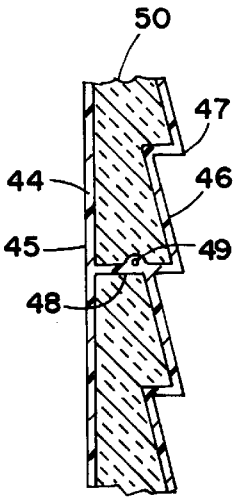
FIG. 5 is an enlarged fragmentary side cross-sectional view of the circled area V—V in FIG. 4.
Figure 5B:
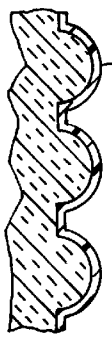
FIGS. 5A and 5B are fragmentary side views of two alternative wall sections having different exterior surfaces.
Figure 5A:
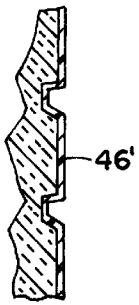

The wall section defining members 33–36 each include an inner layer 44 and an outer layer 46 spaced from inner layer 44 and interconnected to layer 44 by a supporting intermediate layer of reinforcement webs 48 and rigid foam 50, such as is illustrated in FIG. 5. Inner layer 44 and outer layer 46 are comprised of non-foamed structural materials such as thermoplastic polymeric materials chosen to provide load bearing structure to the wall sections. Reinforcement webs 48 are integrally extruded with inner and outer layers 44 and 46. Reinforcement webs 48 stabilize layers 44 and 46 at locations of relatively high stress along the wall sections, and at strategically located points, and can include thicker sections to provide additional support for attached items such as cabinets or doors. Further, inner and outer layers 44 and 46 provide a very durable and long lasting surface that can withstand the abrasion and wear required of a building structure. Notably, layers 44 and 46 can be increased in thickness or otherwise shaped for added strength and/or aesthetics as desired. For example, outer layer 46 can be shaped to replicate clapboard or beveled siding (FIG. 5), dutchlap siding 46' (FIG. 5A), or log-type wall construction 46" (FIG. 5B). It is also contemplated that flanges can be extended inwardly from inner layer surface 45 into interior space 38 or that layer 44 can be made thicker in certain areas to facilitate locating and supporting baseboards, kitchen cabinets, and other building fixtures. Also, longitudinally extending bosses or apertured webs 49 can be positioned on webs 48, such as for receiving a screw or fastener 58 for holding a door casing to a doorway opening (see FIG. 13A), as discussed below.

Still further, the surfaces 45 and 47 of inner and outer layers 44 and 46, respectively, can be textured and colored as desired. For example, outer layer surface 47 can be colored and textured to simulate siding (e.g. aluminum siding or wood siding) or a log home, while inner layer surface 45 can be colored a different color and textured to simulate drywall, paneling, or another surface. Still further, the inner and outer surfaces of any of sidewalls 33 and 34, roof 35, and floor 36 can be colored with different colors selected by a customer. The colors would be continuous throughout layers 44 and 46, and thus would be long lasting. It is contemplated that the coloring could be efficiently and economically done as part of the extruding process such as by adding colorant to the polymer feedstock being fed into the extruding process. Also, additives resisting degradation from ultraviolet radiation could be added to outer layer 46 as desired.

The extruded thermoplastic layers 44 and 46 and reinforcement webs 50 quickly solidify and become rigid after exiting the extruder and extruder die during the extrusion process. Thus, immediately after extruding layers 44 and 46 or at some time soon thereafter, foam material 50 can be added to the wall sections in the space between layers 44 and 46. The inner and outer layers 44 and 46 contain the foam material 50 as it expands. As the foam material solidifies/cures, the foam 50 securely bonds and interconnects layers 44 and 46 to form a rigid "stressed skin" structure having structural elements or "skins" spaced apart by a rigid interconnecting element in a beam-like manner. This stressed skin structure positions structural "skin" portions of the wall sections at the outer edges of the wall sections at an optimal position based on engineering principles for supporting loads.

Figure 4:
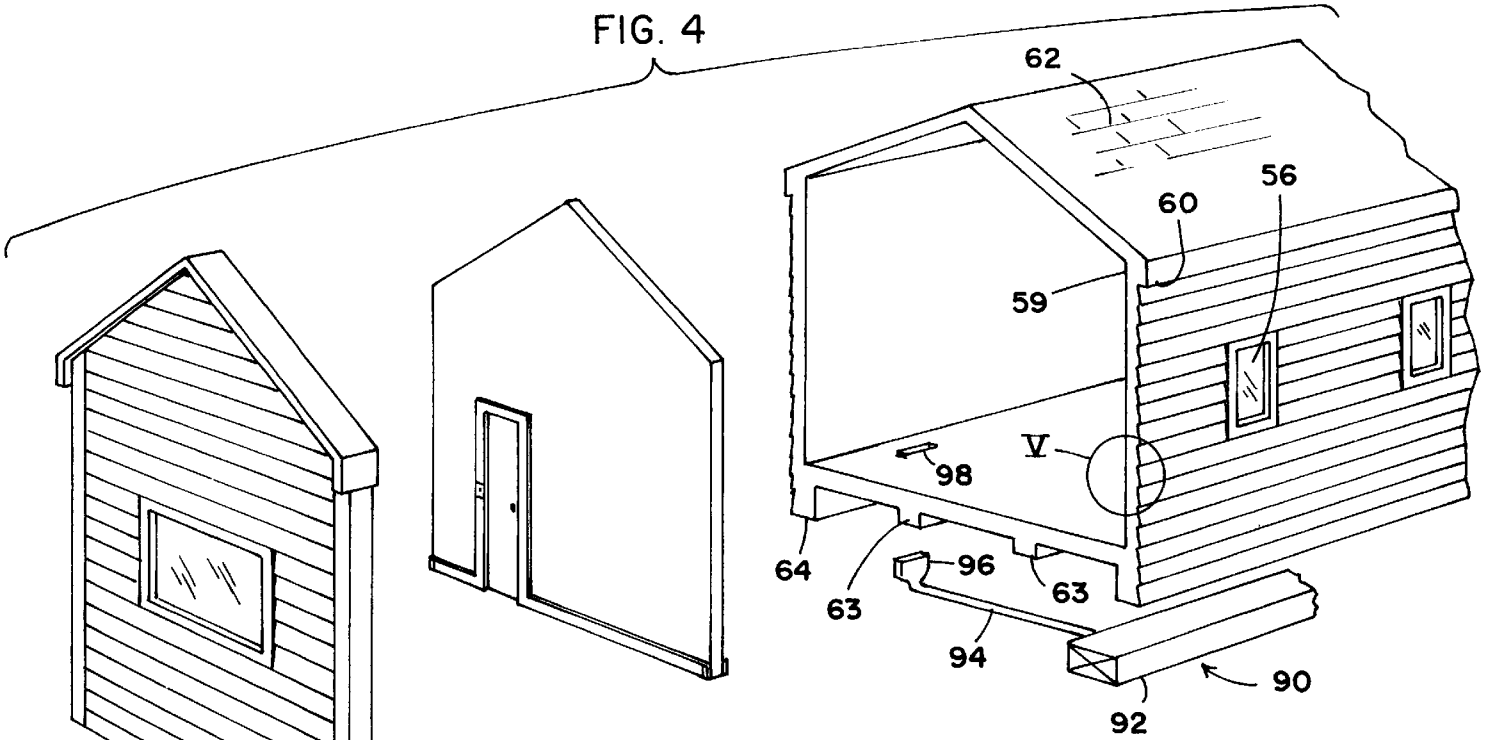
FIG. 4 is an exploded perspective view of the building structure shown in FIG. 1 including an end wall, an intermediate wall, a main building extrusion, and a forced air heat duct assembly.
Figure 18:
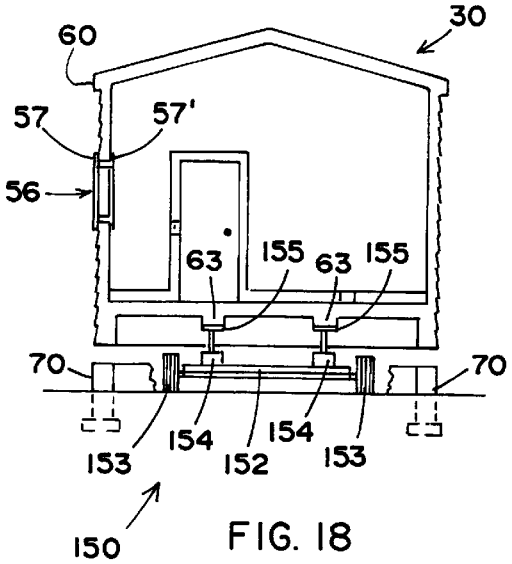
FIG. 18 is a cross-sectional view taken along the planes XVIII—XVIII in FIG. 17.

It is contemplated that layers 44 and 46 and webs 48 will be about on-eighth of an inch thick and will be a structural plastic such as thermoplastic, although alternative materials and thickness can be used. By use of these materials, the wall sections provide a rigid construction which can be cut, drilled, and sawed much like wood, and thus the wall sections readily permit modifications to the extrusion 32. For example, such modifications would be desired for such items as the addition of windows 56 (FIG. 4). Regarding windows, conventional window structures can be positioned in an opening cut into sidewall 33. Alternatively, an inner and outer window frame 57 and 57' could be secured together in a sandwich-like arrangement on sidewall 33 (FIG. 18).

The wall sections also advantageously provide many final features simulating features of a conventionally built wood frame building. For example, the wall section forming the corner 59 (FIG. 4) defined by the roof 35 and sidewall 33 defines a drip edge 60. Notably, an eaves trough (not shown) could also be integrally formed in the extrusion or alternatively a flange could be added for securing an eaves trough to the building structure. Shingles are also simulated by the exterior surface 62 of roof 35.

Figure 6:
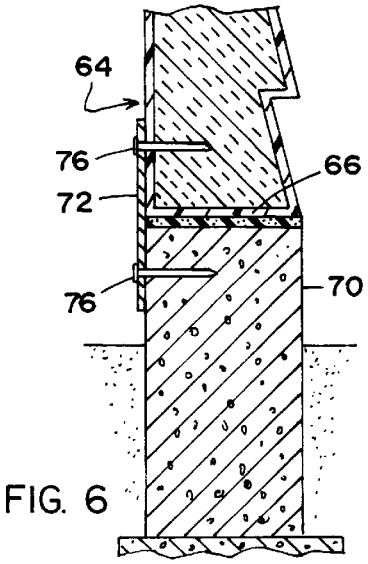
FIG. 6 is an enlarged fragmentary cross-sectional view of the building structure rested on and joined to a foundation.
Figure 7:
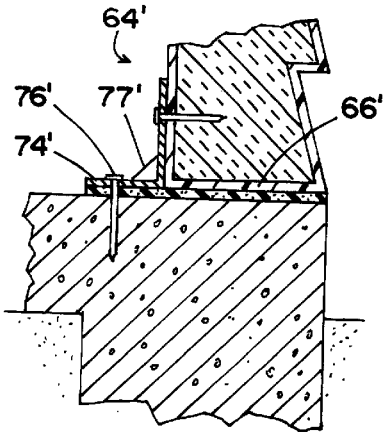
FIGS. 7–9 are enlarged fragmentary cross-sectional views of alternative modified extruded building structures rested on and joined to a foundation.
Figure 17:
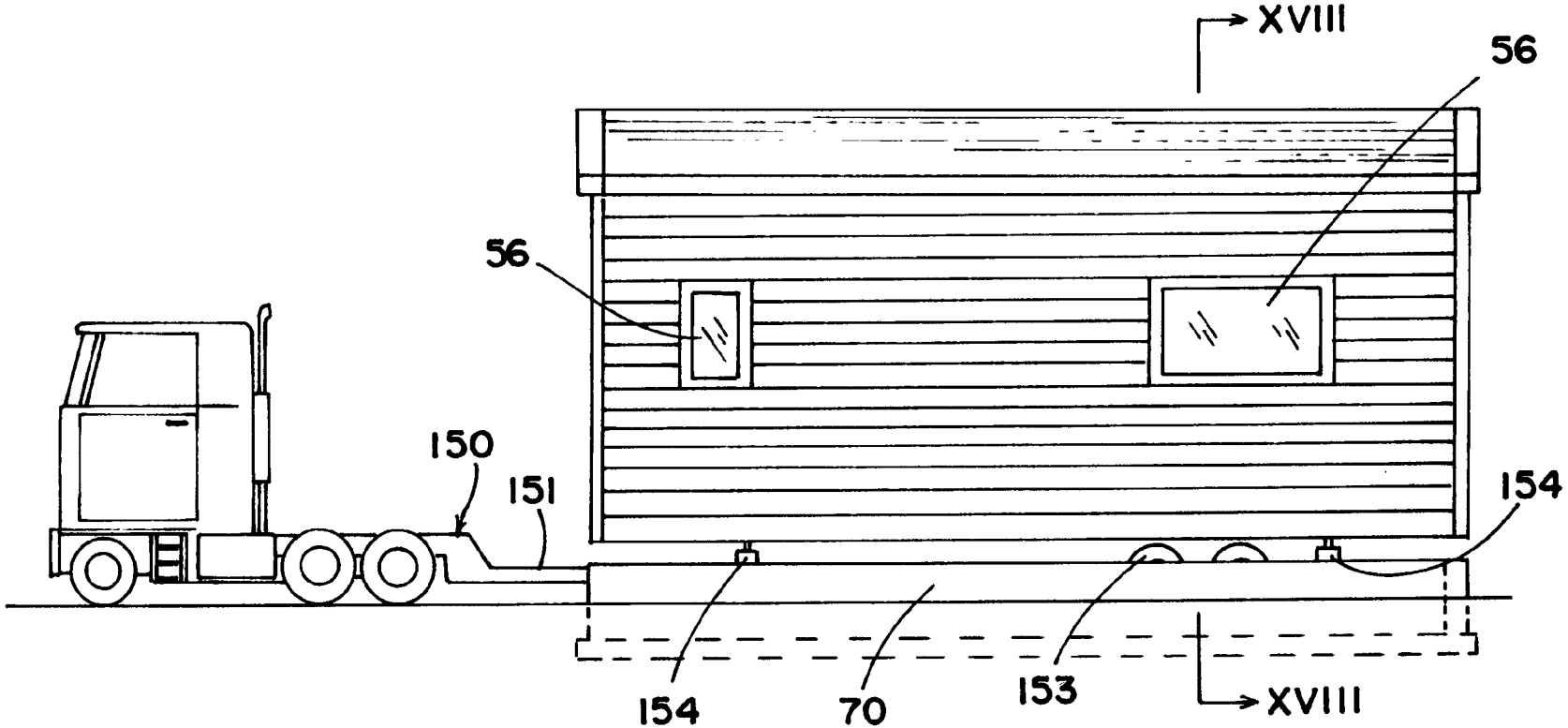
FIG. 17 is a side view of the building structure shown in FIG. 1 on a transport trailer.

A pair of foundation engaging sections 64 extend downwardly from floor 36 under sidewalls 33 and 34. Integral foundation engaging side sections 64 allow space for a hydraulically lowered transport trailer (FIG. 17) to be removed at the construction site, allow a crawlspace for on-site hook-up of utilities such as electricity, water, and sewer lines, and eliminate a need for skirting such as is required on conventional modular units. In this regard, a number of variations are possible. For example, foundation engaging section 64 provides a flat surface 66 for resting on the upper surface 68 of a foundation 70 (FIG. 6). A strap 72 attaches to the side of section 64 and foundation 70 to secure the extrusion 32 to the foundation 70. Strap 72 is interconnected by bolts or fasteners 76 to section 64 and to foundation 70. Alternatively, a foundation engaging section 64' (FIG. 7) can be provided which includes a laterally extending web 74' that extends laterally from the side of flat surface 66'. Foundation engaging section 64' is secured by a fastener 76' that extends through laterally extending web 74 into foundation upper surface 68'. A diagonal reinforcement web 77' is used to stabilize laterally extending web 74 on foundation engaging section 64'. For example, the foundation engaging section 64' could be used when the building structure is to be secured to a concrete slab.

Figure 8:
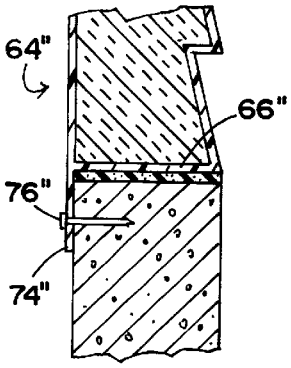
Figure 9:
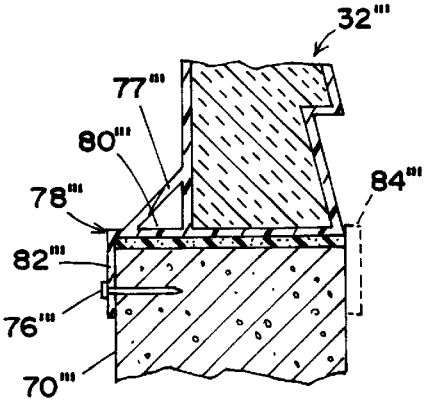

In another modification (FIG. 8), a web 74" is extended downwardly so that it forms a pocket with flat surface 66" for engaging the side and upper surface 68" of foundation 70". A fastener 76" is extended through web 74" to secure extrusion 32" to foundation 70". Still another modification (FIG. 9) includes an L-shaped web 78'" having a lateral web portion 80'" and a downwardly extending portion 82'", lateral web portion 80'" engaging the top of a foundation 70'" and downwardly extending portion 82'" engaging the side of the foundation 70'". Notably, an opposing web 84'" can be positioned opposite downwardly extending portion 82'". Opposing web 84'" forms a channel or guide with portion 82'" which engages both sides of foundation 70'", and thus guides extrusion 32'" onto foundation 70'" such as when a trailer is pulling extrusion 32'" onto foundation 70'". Notably, a removable fixture could also be temporarily attached to the side of foundation engaging section 64'" to accomplish a similar function as web 84'".

Figure 15:
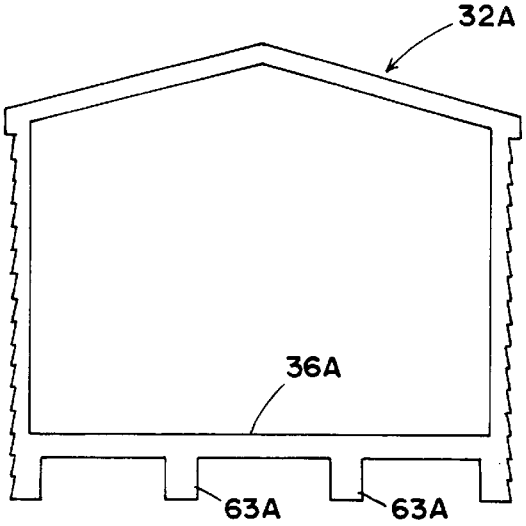
FIG. 15 is an end view of a modified extruded building structure embodying the present invention, the modified building structure including enlarged beam-like structures for engaging a transport trailer.

In another modification (FIG. 15), beam-like sections 63A extend the length of extrusion 32 to help rigidify floor 36. Also, jack-like supports on footers (not shown) can be used to support beam-like sections 63A intermediate their length over a crawlspace or basement. Still further, beam-like sections 63 and 63A provide structure that can be engaged by a trailer, as discussed hereinafter (see FIGS. 17 and 18).

Duct 90 includes a preassembled main heat duct 92 attached to the underside of floor 36 (FIG. 4). One or more flexible tubular branches 94 are connectable to main duct 92 and lead to an outlet 96. An opening 98 is cut into floor 36 to define an opening configured to receive outlet 96. One or more openings 98 can be located in the floor of each room. It is contemplated that flexible branch ducts 94 will be connected to the outlets after transporting building structure 30 to the construction site and the transport trailer is removed.

Figure 10:
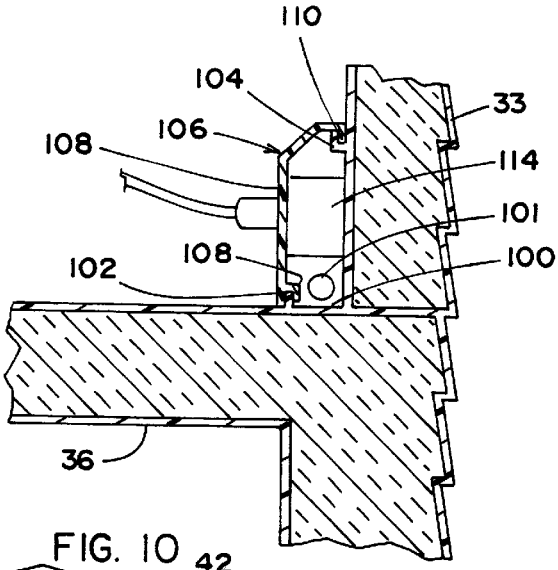
FIG. 10 is an enlarged fragmentary cross-sectional view of the circled area X in FIG. 1 showing a baseboard at the corner defined by the floor and sidewall.
Figure 11:
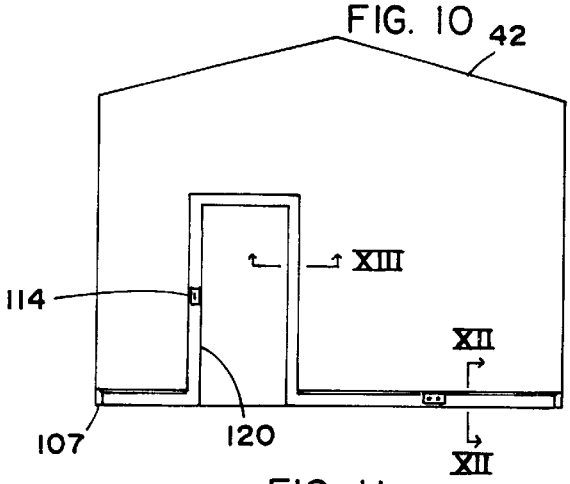
FIG. 11 is a side elevational view of the intermediate wall shown in FIGS. 1 and 4.

A first baseboard engaging flange 102 (FIG. 10) extends upwardly into interior space 38 from floor 36 and a second baseboard engaging flange 104 extends laterally from sidewall 33 (or 34) proximate a corner 100 defined by floor 36 and sidewall 33. Baseboard 106 includes a cover section 108 for covering wires 101 and flange engaging edges 110 and 112 for engaging flanges 102 and 104. Baseboard 106 is snap-locked onto flanges 102 and 104 to cover wires extending along the corner 100. Electrical outlets 114 are located along baseboard 106 as often as desired. It is contemplated that the wiring 101 will be prefabricated units that snap together much like a wiring harness in an automobile, although conventional wiring could also be used. The wiring 101 can be extended through intermediate wall 42 through a hole 107 in intermediate wall 42 (FIG. 11) at the corners of wall 42 or through doorway openings cut into wall 42 (see FIG. 13).

Figure 12:
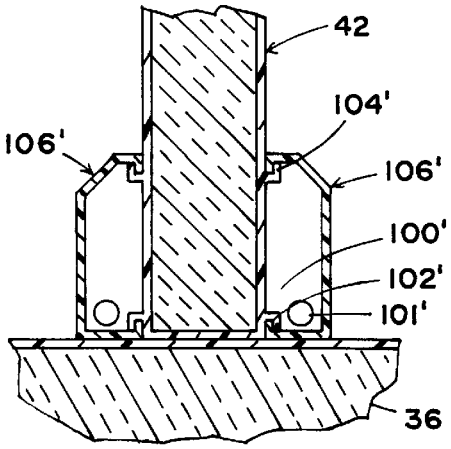
FIG. 12 is a cross-sectional view taken along the plane XII—XII in FIG. 11 showing the baseboard at the corner defined by the intermediate wall and the floor.

FIG. 12 shows an alternative arrangement wherein both of baseboard engaging flanges 102' and 104' extend from, in this case, intermediate wall 42. A modified baseboard 106' is configured to engage and be frictionally retained on flanges 102' and 104'. Wires 101' are routed through the space defined by baseboard 106' and corner 100' defined by floor 36 and intermediate wall 42. Notably, flanges 102' and 104' are located on both sides of intermediate wall 42 and baseboards 106' are also locateable on both sides of intermediate wall 42.

Figure 13:
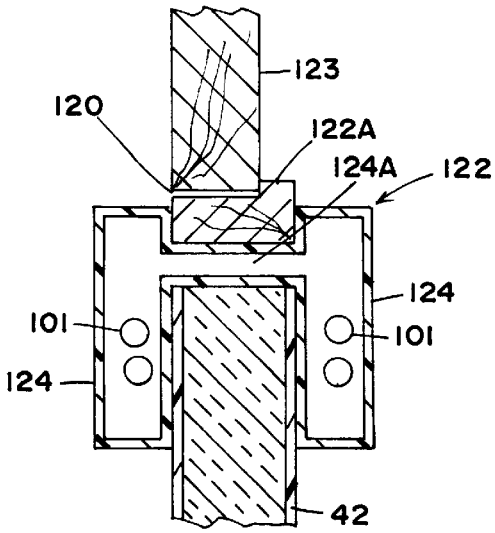
FIG. 13 is a cross-sectional view taken along the plane XIII—XIII in FIG. 11 showing the door casing and doorway opening.
Figure 13A:
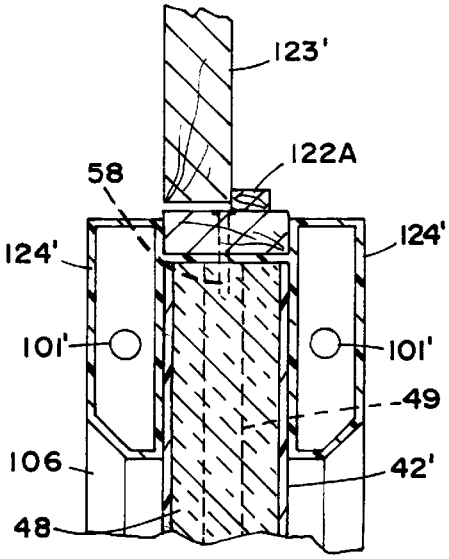
FIG. 13A is a cross-sectional view comparable to FIG. 13 but showing an alternative door casing construction.

It is contemplated that intermediate wall 42 and end wall 40 will be constructed of an extrusion including inner and outer layers supported by an intermediate layer of foamed material and/or reinforcement webs not unlike the wall sections previously described (see FIGS. 12 and 13). End wall 40 and intermediate wall 42, after extrusion, are precisely cut to the necessary shape to match up with main extrusion 32. Advantageously, excess material cut away from walls 40 and 42 can be separated and recycled back into the extrusion process. However, it is also contemplated that alternative intermediate wall constructions are possible, such as conventional 2×4 wood and drywall constructions. Advantageously, the extruded intermediate wall 42 can be cut with conventional hand-held or hand-operated equipment such as a skill saw or the like. Thus, doorway openings 120 (FIG. 11) and other openings or holes can be readily formed in intermediate walls 42.

Casings such as extruded C-shaped casings 122 (FIG. 13) can be positioned in doorway openings 120 with the legs 124 of C-shaped casings 122 engaging and retaining casings 122 in doorway opening 120. Casing 122 is shaped to mateably receive conventional wood casing 122A and is configured to be sufficiently rigid to support a door 123 including door hinges and a door catch or striker plate (not specifically shown). In one version, casing legs 124 are hollow and the web 124' connecting legs 124 has at least a hole through it so that wires 101 can be routed in casing 122 around and through doorway opening 120.

An alternative door casing 122' (FIG. 13A) includes a pair of hollow casing legs 124' that are not unlike baseboard covers 106. In this arrangement, conventional wood casing 122A is secured to wall 42 by a fastener 58 that extends into a boss 49 in web 48 of intermediate wall 42.

Figure 14:
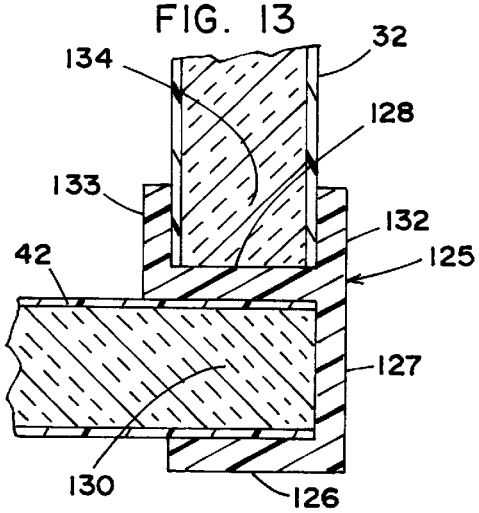
FIG. 14 is a fragmentary cross-sectional view of an end corner of the building structure taken along the plane XIV—XIV in FIG. 3.

End wall 40 (FIG. 14) is connected to the end of extrusion 32 by an extruded connector 125. Extruded connector 125 includes flanges 126–128 for defining a first pocket 130 for receiving an edge of end wall 40. Connector 125 further includes flanges 132 and 133 that form with flange 128 a second pocket 134 for receiving an end of extrusion 32.

Pockets 130 and 134 are oriented perpendicularly to each other. It is contemplated that multiple connectors 125 will be positioned around the five linear sides of end wall 40. The connectors 125 will be secured to end wall 40 and extrusion 32 by adhesive 136 which will seal the joint so that the joint is leak-free. Optionally, fasteners (not shown) such as nails, screws, or bolts can be used to secure the joint together if desired. It is noted that a variety of differently shaped connectors 125 are possible. For example, connectors 125 could be made thinner, or flanges 126, 132, or 133 could be eliminated.

Figure 14A:
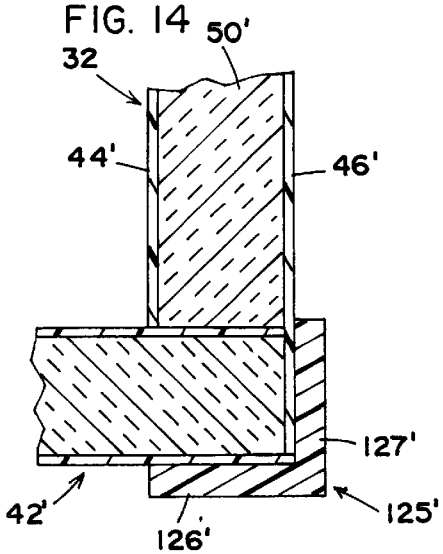
FIG. 14A is a fragmentary cross-sectional view comparable to FIG. 14 but of an end corner of an alternative construction.

In another alternative, an L-shaped extruded connector 125' (FIG. 14A) including side pieces 126' and 127' is used. Outer layer 46' is extended past the end of extruded wall sections 33–36 to create a rabbit joint. End wall 42' is extended into the rabbit joint and the joint is secured together by adhesive, sealant, and fasteners as desired. Notably, separate connectors could be used inside and outside the joint or the connectors could be eliminated by use of an adhesive that adequately seals and bonds the joint together.

Figure 16:
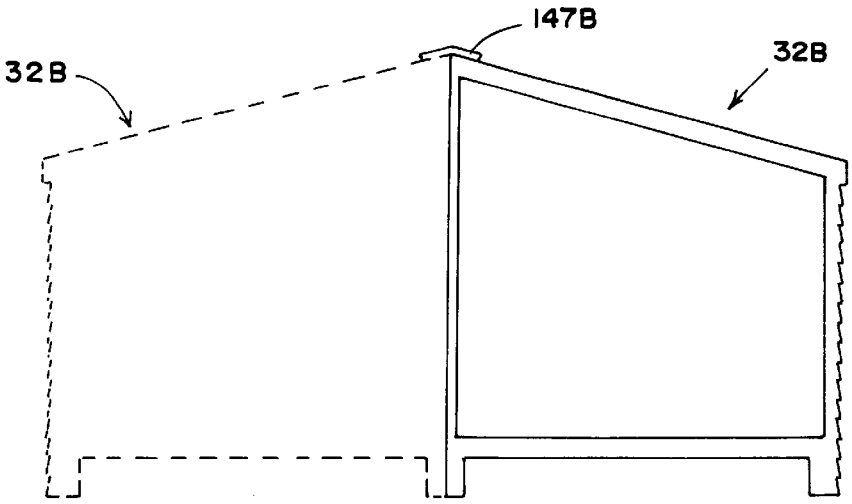
FIG. 16 is an end view of another modified building structure embodying the present invention, the modified building structure being configured to form a double wide building structure and including a field applied roof cap/cover plate.

It is contemplated that extrusions 32 can be modified for particular applications. For example, modified extrusion 32B (FIG. 16) includes a trapezoidal shape configured to mate with a second extrusion 32B (shown in phantom) to form a double-wide building structure. Notably, it is not necessary that both extrusions 32B have identical shapes. A roof cap or cover plate 147B is applied to the peak of the double-wide building structure on site to prevent moisture intrusion at the peak. The ends of the double-wide building structure are covered or sealed as desired.

Building structure 30 (FIGS. 17 and 18) is transportable on a trailer 150. Trailer 150 includes a bed 151 supported by axles 152 and tires 153. Extrusion engaging jacks 154 are positioned on bed 151. Jacks 154 include an upper end 155 configured to engage beam-like sections 63 under floor 36 to hold building structure 30 on trailer 150 during transport. Also, jacks 154 allow building structure 30 to be carried at a desired height on trailer 150 to meet local highway regulations, and in particular allow the building structure to be carried high enough so that the foundation engaging sections 64 do not drag on a road surface during transport. Jacks 154 allow building structure 30 to be lifted or lowered for positioning the building structure over a foundation 70. Building structure 30 can then be lowered onto the foundation 70 and secured thereto (see FIGS. 6–9). A front cover or skirt is applied after the trailer is removed and utility connections are made.

Figure 20:
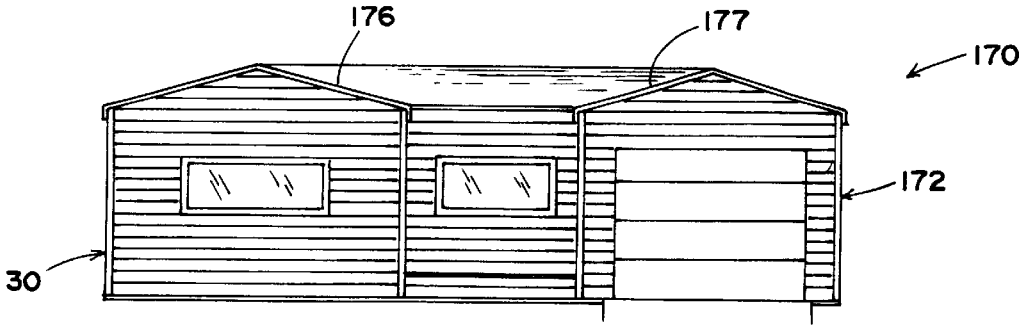
FIG. 20 is a front view of the building structure shown in FIG. 19.
Figure 19:
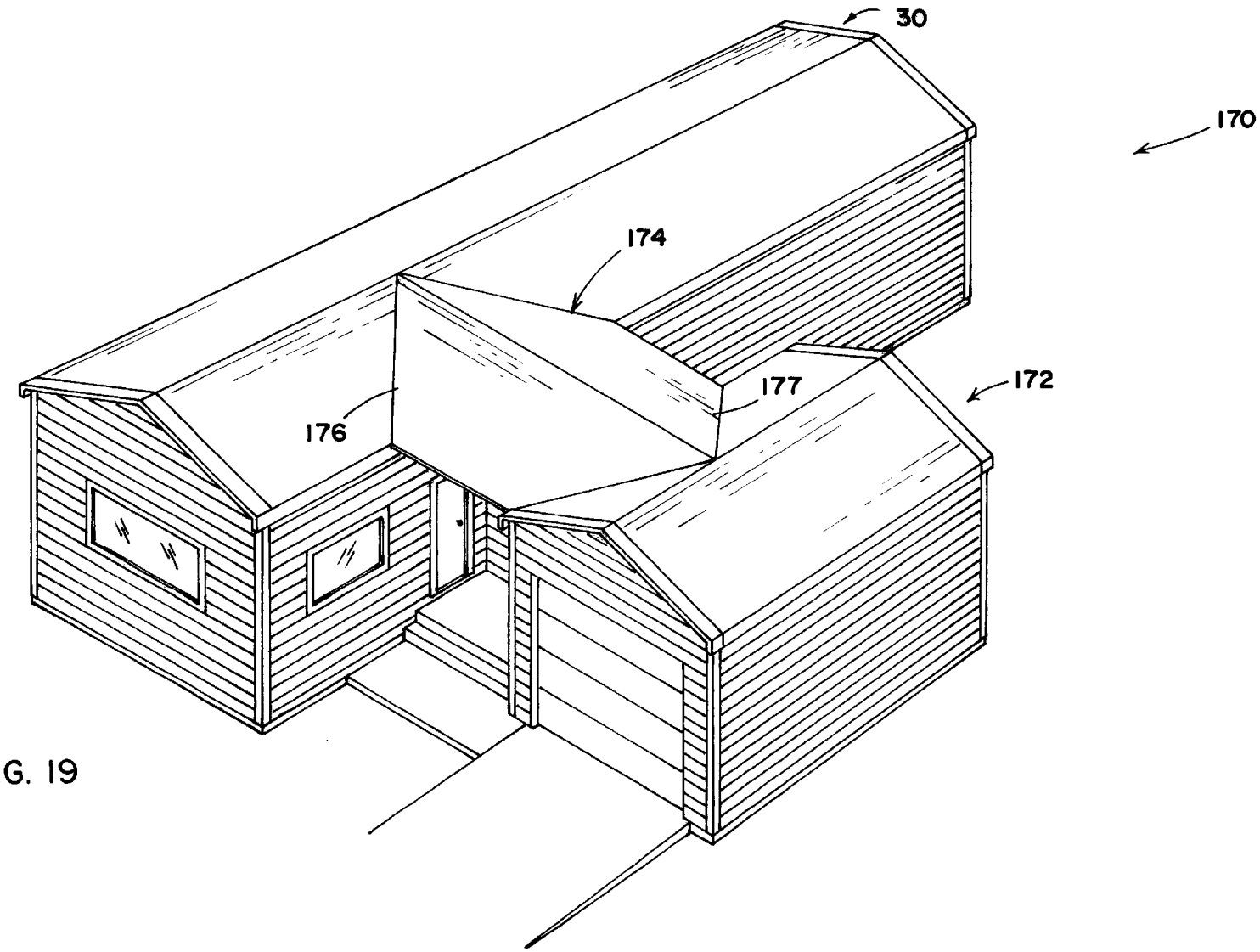
FIG. 19 is a perspective view of a building structure embodying the present invention, the building structure including a main extruded building structure configured to be used as living quarters and an extruded garage structure attached to the main building structure by an extruded breezeway structure defining a three-season room.
Figure 21:
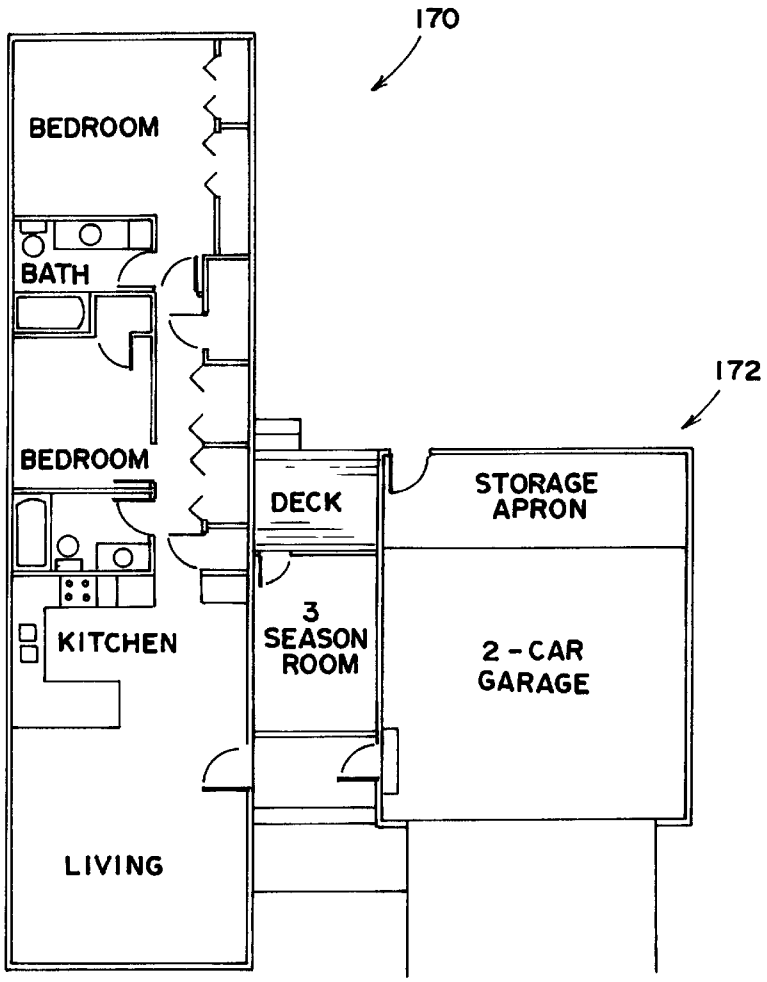
FIG. 21 is a plan view of the building structure shown in FIG. 19.

A building structure 170 (FIGS. 19 and 20) incorporates a building structure 30 with an extruded building structure 172 positioned parallel building structure 30 and interconnected to building structure 30 by an extruded breezeway 174. Building structure 30 is about 40 feet long to accommodate the floor plan illustrated in FIG. 21, but can be made substantially any length desired. Breezeway structure 174 (FIG. 20) includes a tubular shape comparable to building structure 32. Specifically, breezeway structure 174 includes orthogonally related sidewalls and a floor having a length of about 10 to 12 feet in order to form a good sized room. The sidewalls and floor are cut vertically so that the end of breezeway structure 174 closely engages the sides of building structure 30 and building structure 172. However, the roof of breezeway structure 174 is cut at an angle longitudinally so that the ends 176 and 177 of the roof mateably engage the sloping sides of the roof on building structure 30 and building structure 172. Notably, the "garage" building structure 172 can be constructed as a double-wide structure in order to receive two cars (see FIGS. 16 and 21), or as two short extrusions cut transversely to a size that will allow the building structure to be shipped on a highway. Optionally, the "garage" building structure can be made long enough to receive two cars (see FIG. 22). Notably, for tooling economy, the die for manufacturing the building structure 172 could utilize the same extruding die as main building structure 32, except with the floor portion 36 closed off or "blocked out."

Figure 22:
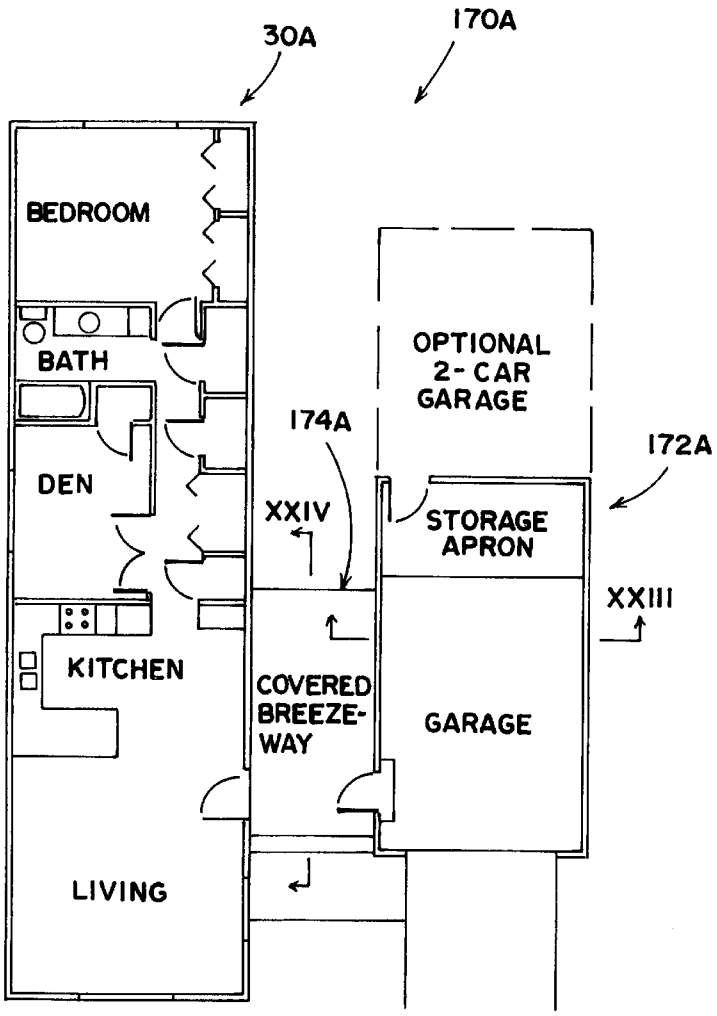
FIG. 22 is a plan view of a modified building structure embodying the present invention, the building structure including a main extruded building structure configured to be used as living quarters and an attached garage structure attached to the main building structure by an extruded roof structure.
Figure 26:
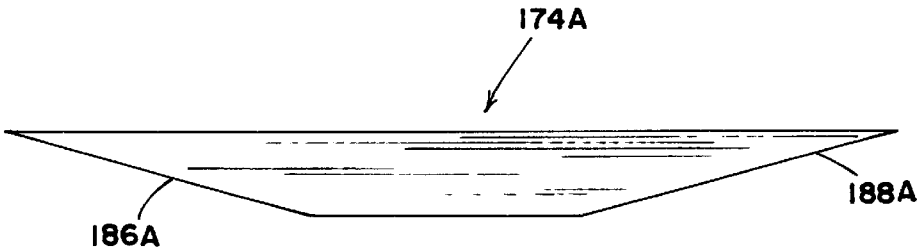
FIG. 26 is a side elevational view of the extruded breezeway roof structure shown in FIG. 22.
Figure 27:
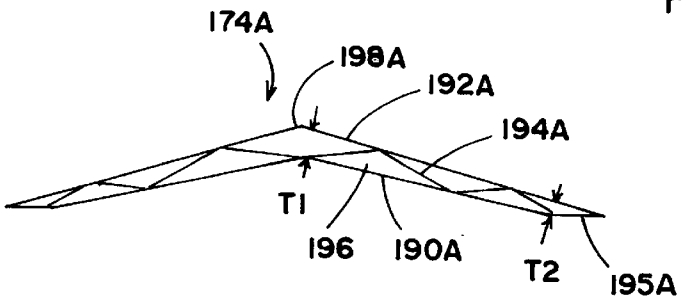
FIG. 27 is an end view of the breezeway roof structure in FIG. 26.

As illustrated in FIG. 22, modified building structure 170A includes an extruded building structure 30A, an extruded building structure 172A, and an extrusion 174A interconnecting same. Building structure 30A is extruded and cut to a shorter length than building structure 30 to accommodate a reduced floor plan. Notably, building structure 172A is a one-car structure and is smaller in width than the building structure 172 shown in FIG. 21. Breezeway structure 174A defines a roof with ends 186A and 188A (FIGS. 26 and 27) that rest on and engage the sloping sides of the roof of building structure 30A and 172A (see FIG. 20 for comparison). Notably, breezeway structure 174A does not include sidewalls. It is noted that different breezeway structures could be developed that incorporate one or more sidewalls and that the breezeway structures can be of any length or shape as desired.

Breezeway structure 174A (FIG. 27) includes inner and outer layers 190A and 192A interconnected by truss simulating webs 194A. The spaces within breezeway structure 174A can be filled with foam 196A for additional rigidity or load bearing capability if needed. The thickness of breezeway structure 174A increases to a thickness T1 near the peak 198A and the thickness lessens near the edges 195A to a thickness T2.

Figure 23:
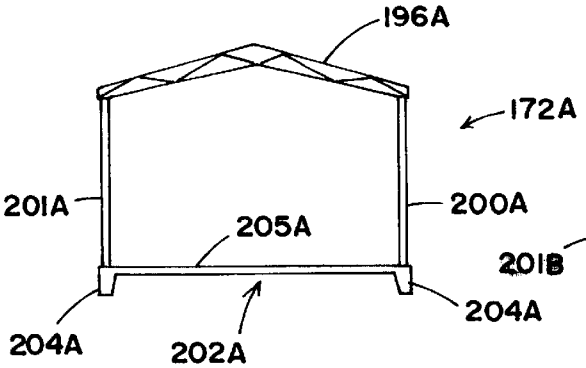
FIG. 23 is a cross-sectional view taken along the plane XXIII—XXIII in FIG. 22 showing the garage structure.

Building structure 172A (FIG. 23) includes a roof 196A not unlike breezeway structure 174A; however, building structure 172A further includes sidewalls 200A and 201A. Notably, building structure 172A does not include a floor but rather is rested on a concrete slab 202A with footers 204A, slab 202A providing a rough non-slip surface 205A for supporting an automobile.

Figure 25:
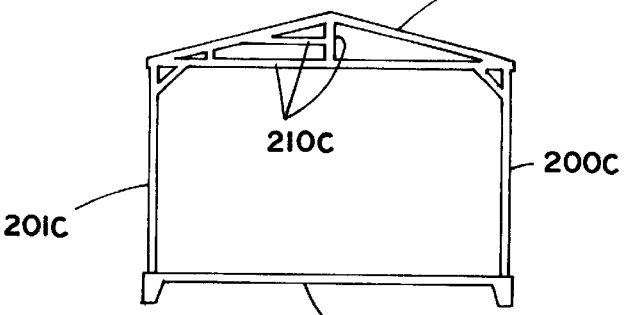
FIG. 25 is a cross-sectional view of another modified building structure generally similar to that shown in FIG. 23 but including non-uniformly positioned discrete truss members.
Figure 24:
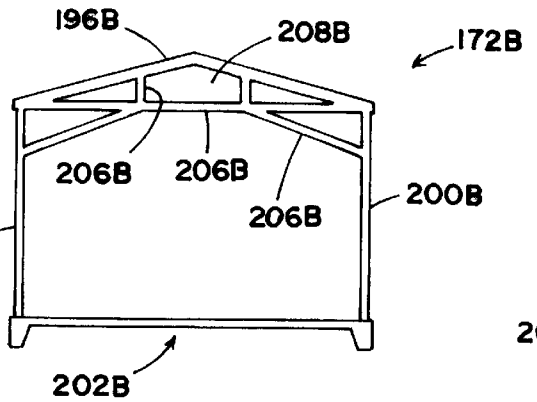
FIG. 24 is a cross-sectional view of a modified building structure generally similar to that shown in FIG. 23 but including integral but discrete truss members.

Additional various garage-like building structures are disclosed in FIGS. 24 and 25. Building structure 172B (FIG. 24) is similar to building structure 172A, except it includes discrete truss simulating beams 206B that extend longitudinally. Access to the attic area 208B can be achieved by cutting an access opening through one or more locations in the lowermost of beams 206B. Building structure 174C (FIG. 25) is similar to building structure 174B, except it includes non-uniformly positioned truss simulating beams 210C for supporting non-uniform loads on the roof of building structure 172C. For example, non-uniform loads may be experienced by placing a breezeway structure such as extrusion 174A thereon (see FIGS. 26 and 27). The beams 210C support this increased load from breezeway structure 174A.

Figure 28:
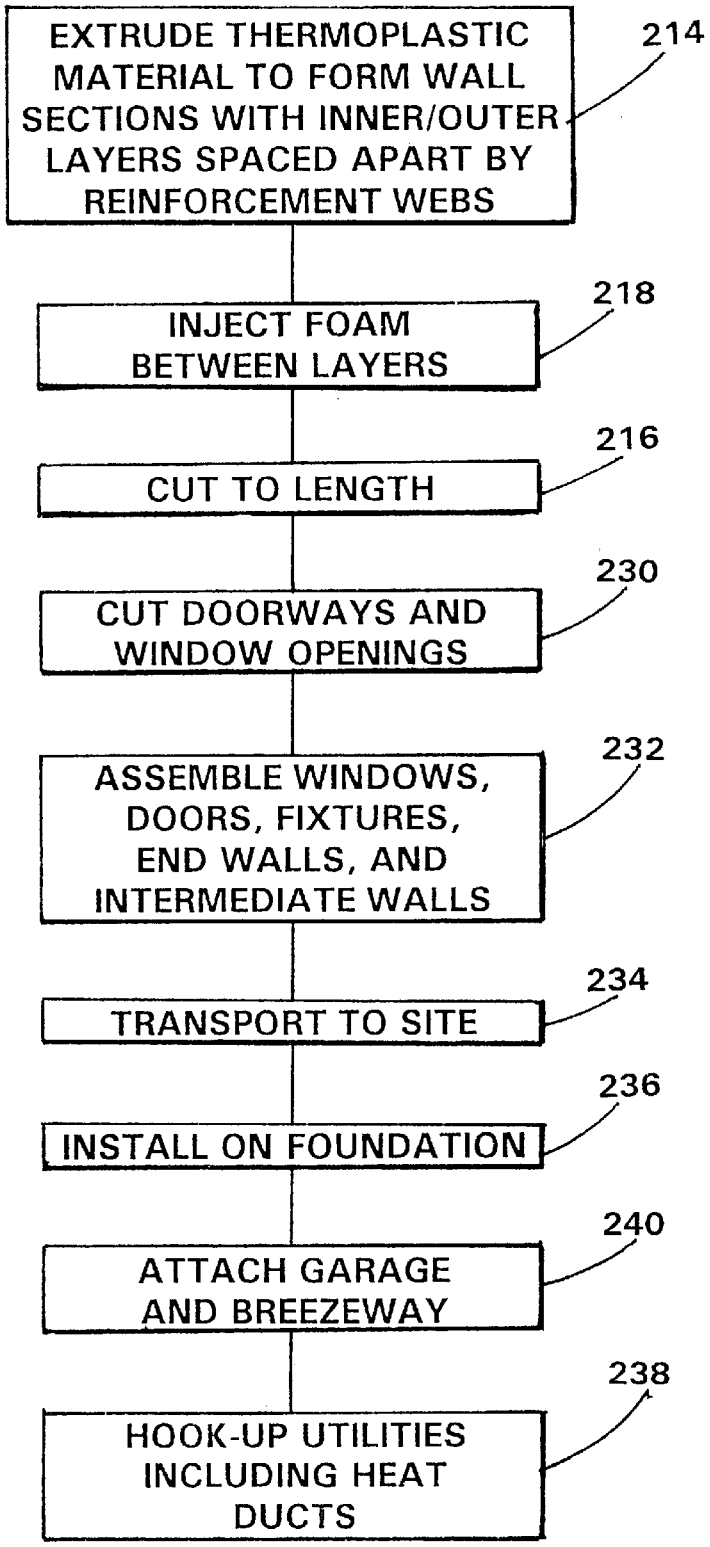
FIGS. 28 and 29 are flow diagrams for a method of manufacturing the extruded building structures noted above.
Figure 29:
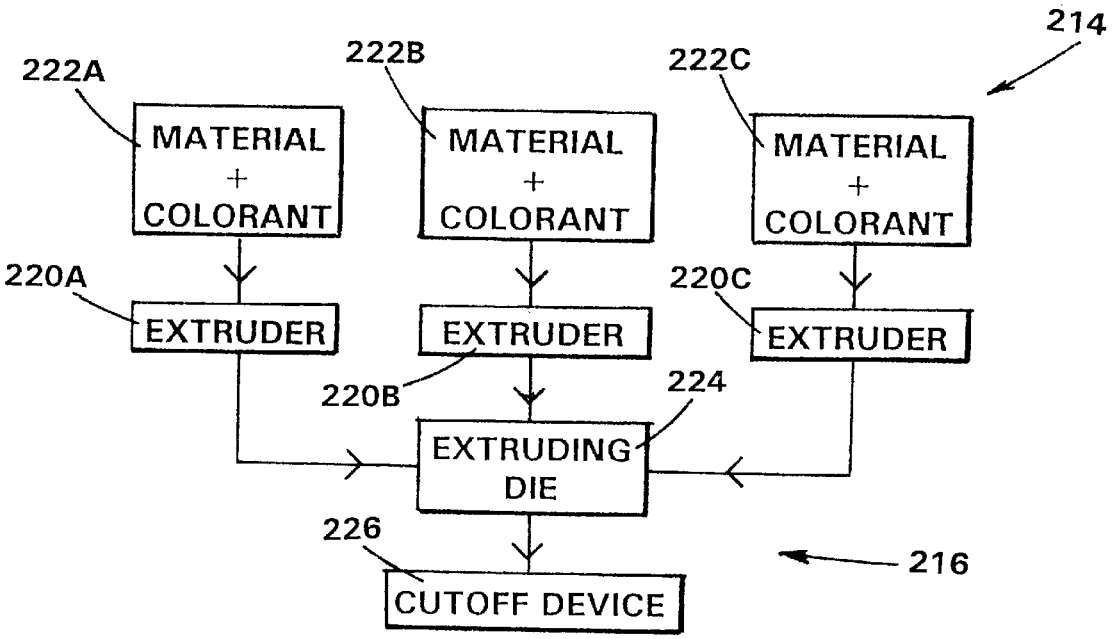

The method of manufacture of an extruded building structure, such as structures 30, 40, 42, 124, 172, 172A, 172B, 172C, 174, and 174A, is illustrated in FIGS. 28 and 29. The process of extruding thermoplastic material is generally known, and thus detailed equipment disclosure is not necessary for a working understanding of the present invention. Initially, in step 214, thermoplastic material is extruded by an extruder through an extruding die to form integral wall sections, such as wall sections 33-36 for building structure 30 (FIG. 28). Notably, where a multicolored extrusion is desired, multiple extruders, such as extruders 220A, 220B, and 220C (FIG. 29), can be used to process different materials, such as materials and colorants 222A, 222B, and 222C, through a die 224. Thus, extrusion 32 would have multicolored wall sections customized to a customer's specifications. For example, the sidewall and roof interior surfaces could be off-white in color, while the sidewall interior surface could be tan in color and the roof exterior surface could be black in color. In step 216, the extrusion is extruded to the desired length and cut off by cutoff device 226 (FIG. 29). It is contemplated that cutoff device 226 will move with the extrusion during the step of cutting so that the extrusion process is continuous, although the extrusion process could also be stopped temporarily to permit cutting if desired. Simultaneously, while extruding extrusion 32 (i.e. step 218) or some time soon thereafter, foam material 50 is injected into the space between thermoplastic inner and outer layers 44 and 46. Optimally, it is contemplated that the foaming device will attach to and be an integral part of the extruding die.

Once the wall sections of the extrusion are sufficiently rigid, window openings and doorways are cut into the extrusion (i.e. step 230) by a device such as a computer controlled traveling saw. Window assemblies, doorway casings, fixtures, and other items are then attached to the wall sections in step 232. Also, intermediate walls and end walls are added as required. Building structure 30 is otherwise substantially completely assembled at the factory such as by the installation of kitchen appliances and cabinets, bathroom fixtures, etc.

Once substantially completed, the building structure is loaded onto a trailer for transport (i.e. step 234). After installation on a foundation (i.e. step 236), the building utilities of building structure 30 are connected to utility hook-ups on site in step 238. Also, in the case of multiple extrusions, the extrusions are interconnected in a predetermined arrangement according to a layout (i.e. step 240).

Figure 29A:
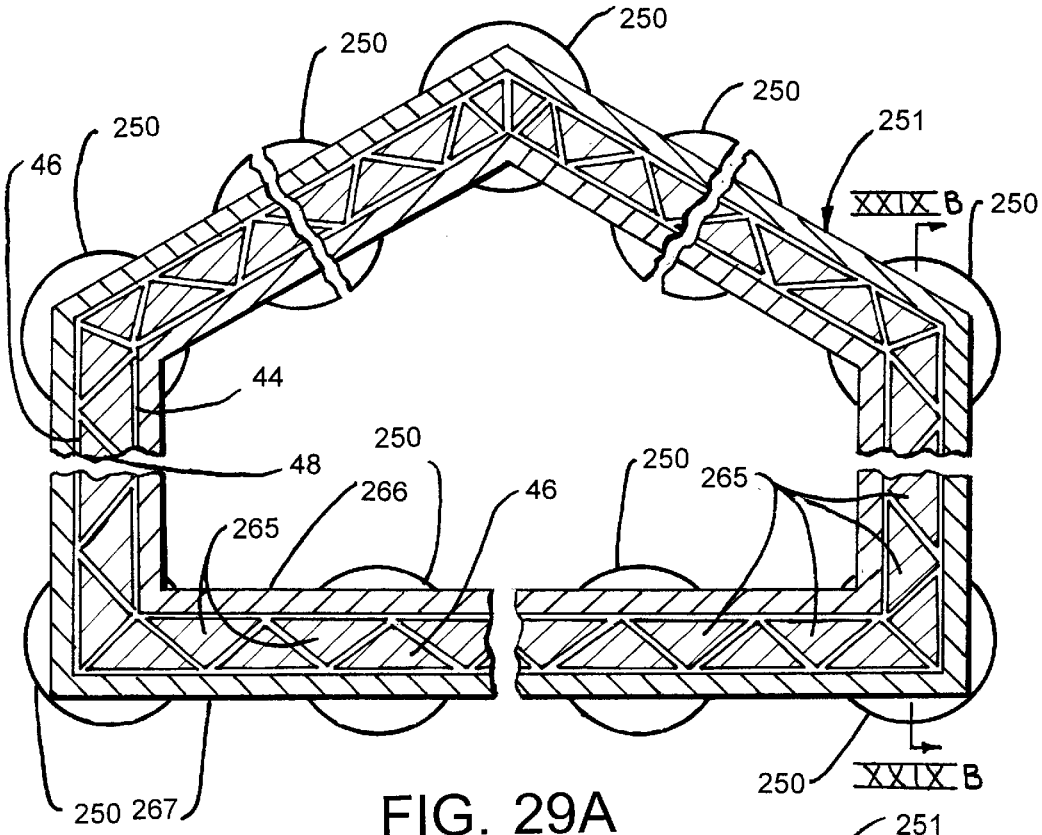
FIGS. 29A and 29B are end and side views of an arrangement of extruding equipment.
Figure 29B:
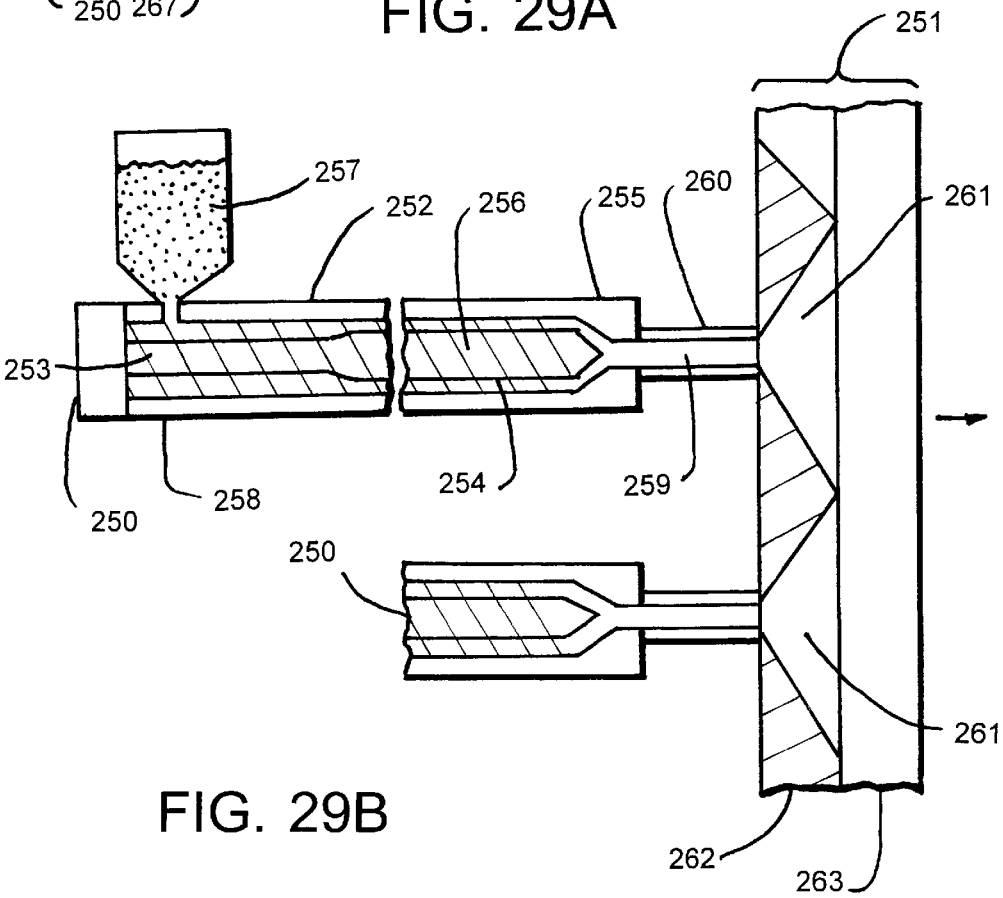

One arrangement of equipment for extruding the extrusion 32 is shown in greater detail in FIGS. 29A and 29B. Multiple extruders 250 (FIG. 29A) are positioned around the extrusion forming die 251 in sufficient number and size to provide the volume of molten plastic to form the extrusion 32 at a reasonable rate. For example, where the wall layers 44, 46, and 48 are each about 0.125 inches thick, it is estimated that the extrusion 32 will consume about 2,000 to 2,500 cubic inches of polymeric material per linear longitudinal foot of extrusion 32 (depending on the overall dimensions of the extrusion 32). The output speed of the line is a direct function of the total output of extruders 250. The extruders 250 (FIG. 29B) each include a barrel 252 and a screw 253 rotatably positioned in the barrel 252. Screw 253 includes a shaft 254 that increases in diameter toward the front end 255 of barrel 252. The screw 253 includes flights 256 trapping pellets of thermoplastic polymeric material 257 at the rear end 258 of the barrel. This material 257 is moved forward, compressed, and heated from mechanical friction from turning screw 253 and from heaters on barrel 252. Enough heat is generated to melt the material 257 into a uniform molten mass 259. A primary extruder nozzle 260 conveys the molten polymeric mass 259 to funnel-shaped passageways 261 in heated manifold funnel die 262. A profile die 263 is attached to manifold 262 and receives the molten polymeric mass 259. Profile die 263 includes mandrels 265–267 (FIG. 29A) that define therebetween a space in the shape of extrusion 32. Specifically, the internal mandrels 265 of profile die 263 are bolted to manifold 262 and are shaped like the cavities between wall layers/sections 44, 46, and 48. The inner and outer mandrels 266 and 267 are positioned around the inner and outer perimeters of extrusion forming profile die 263 to define the inside surface and outside surface of extrusion 32. The mandrels 265–267 are cooled by coolant flowing through lines in die 263, such that the molten mass 259 is quickly cooled into the shape of extrusion 32. Heaters in heated manifold 262 keep the molten mass 259 heated in the heated manifold 262, and insulation around the coolant lines keep the lines from prematurely cooling the heated manifold 262 or the molten polymeric material in the heated manifold 262. The multiple extruders 250 are coordinated to co-extrude portions of the extrusion 32 simultaneously. Co-extrusion of materials is known and it is not necessary to describe such processes in this application to enable a person skilled in the art of extruders. Foam can be added through piping attached to extrusion forming die 251 or can be added after the extrusion 32 has cooled to a more stable temperature at a location significantly downstream of the die 251. Notably, one or more of the cavities formed by internal wall mandrels 265 can be left empty and not filled with foam if desired, such that they form raceways for receiving utilities.

Sizing dies, fluid, air pressure, or vacuum can be used to slidably support the extruded shape as it exits extruding die 251 until it adequately cools to support itself. One known sizing device (also known as a calibration device) utilizes vacuum to hold extruded material against a planar surface in a flat/planar condition as it cools coming out of the extruder die. For example, such vacuum calibration equipment is sold by Uniplast International, Inc., of Meadville, Pa. This vacuum-type calibration/sizing device has the advantage that a section such as layer 44 can be supported from one outer side against a mating surface as the extruded material cools.

The mass and weight of extrusion 32 is substantial and it is contemplated that the extrusion 32 will be pulled or drawn from the profile die 251 (rather than merely being pushed by newly formed portions of the extrusion 32). For this purpose, any one of all of the following can be done Inner and/or outer pullers or a conveyor belts/carriers can be positioned around and under the extrusion 32 to assist its movement out of die 251. In the extrusion die arrangement of FIGS. 29A and 29B, the foam 50 is injected after the extrusion 32 is cooled. The foam 50 adheres to the wall layers 44, 46, and 48 to form a stressed skin beam section having significant structural stiffness. Alternatively, the extrusion 32 can be extruded vertically downwardly such that gravity pulls the extrusion 32 from profile die 251. In such case, a lift will be provided to vertically support the extrusion 32 to prevent the extrusion's own weight from pulling with too great of a force. The lift may include an inner pentagon-shaped arrangement of flat conveyor belts for telescopingly receiving and supporting the extrusion as the extrusion exits die 251.

As illustrated in FIG. 29A, the intermediate reinforcement layers 48 of the extrusion 32 can be angled relative to wall layers 44 and 46 or can be oriented perpendicularly to provide optimal stress distribution and support for the wall layers 44 and 46.

Figures 29C, 29D, 29E:
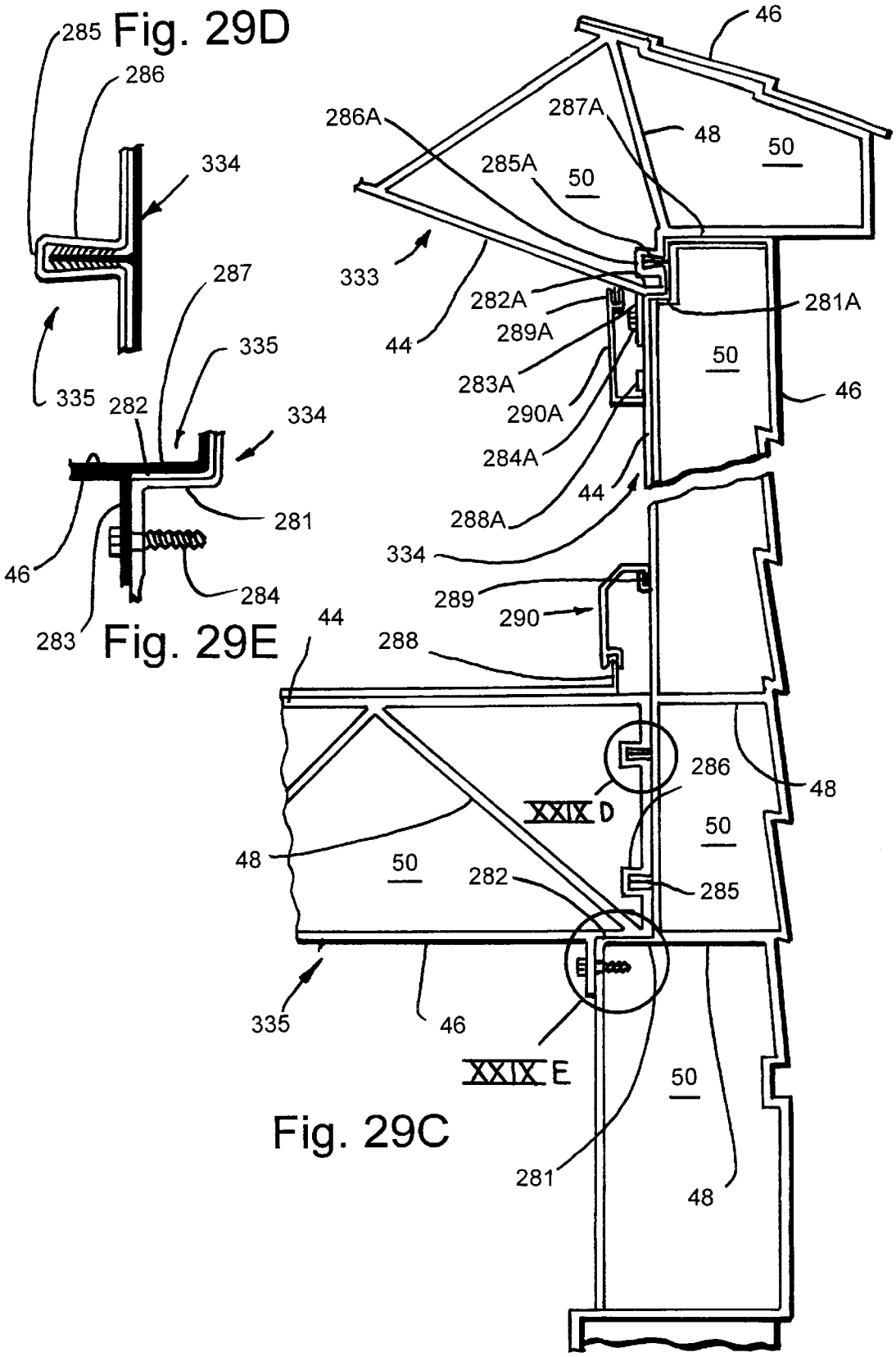
FIG. 29C is a cross-sectional view of a building constructed from multiple longitudinally extending tubular extrusions connected together, the extrusions including a one-piece floor, a one-piece building wall, and a one-piece roof joined together to form an integral extruded building.
FIGS. 29D and 29E are enlarged cross sections showing different connection arrangements for interconnecting the multiple extrusions of FIG. 29C.
Figures 30, 31:
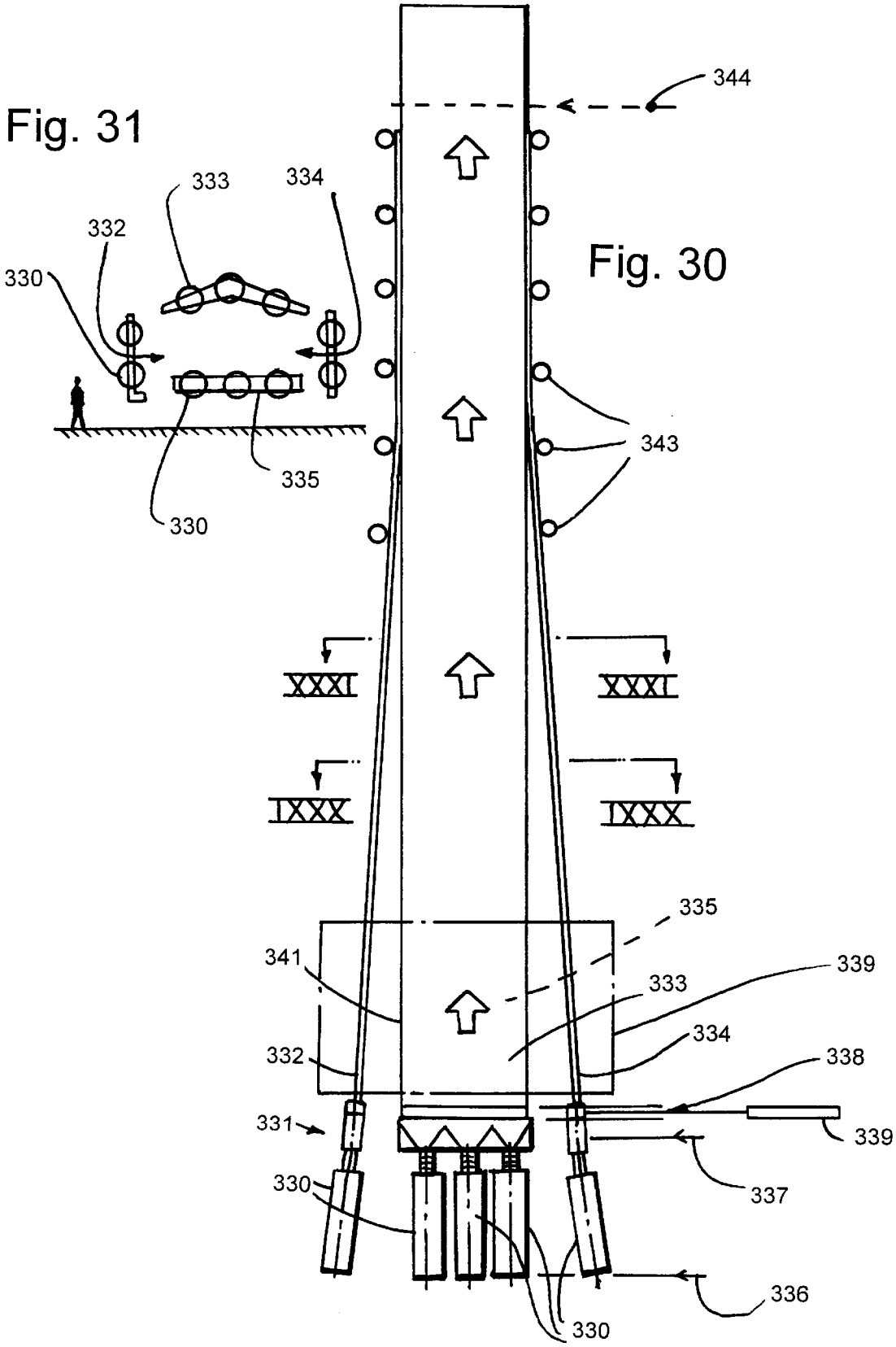
FIG. 30 is a plan view of another arrangement of extruding equipment.
FIG. 31 is an end view of the arrangement shown in FIG. 30.

FIGS. 29C and 30 disclose an extruded building constructed from multiple large extrusions 332–335 brought together at a manufacturing site to form a single one-piece large construction. Extrusions 332–335 (FIG. 31) form a building sidewall, a building roof, another building sidewall, and a building floor, respectively. (Notably, sidewall extrusion 332 is a mirror of extrusion 334.) Specifically, roof extrusion 333 (FIG. 29C) includes an outer layer 46 forming a shingle-simulating surface, and sidewall extrusion 334 includes an outer layer 46 forming a vinyl siding-simulating surface, and an inner layer 44 forming a drywall-like flat surface.

Intermediate ribs 48 are formed at an angle (see roof extrusion 333 and floor extrusion 335) or perpendicularly (see sidewall extrusion 334) as needed to best distribute stress throughout the building structure.

Sidewall extrusion 334 (FIG. 29C) is extruded to form a ledge 281 for receiving a mating notch 282 at an end of floor extrusion 335. Notch 282 is defined by a guide flange 283 (FIG. 29E) that extends below floor bottom layer 46. Flange 283 includes apertures for receiving screws or nails 284 to fixedly secure floor extrusion 335 to sidewall extrusion 334. Adhesive 287 or other securement means can also be used to secure the connection.

A second connection is formed above notch 282 by a pair of finned connectors 285 (FIG. 29D) on sidewall extrusion 334. Connectors 285 each mateably engage a dovetail-type notch 286 in the end of floor extrusion 335. Specifically, the fins on connectors 285 are stiff but flexible, such that they telescopingly slide horizontally into notch 286 but so that they lockingly non-removably engage the notch 286. Thus, the sidewall extrusion 334 can be pressed horizontally into engagement with the end of floor extrusion 335 while the ledge 281 guides the interconnection. Components 285 and 286 engage so that the connection temporarily secures the joint to allow the adhesive 287 to cure (or to allow fasteners/bolts 284 on flange 283 to be driven in). Flanges 288 and 289 on floor extrusion 335 and sidewall extrusion 334 receive mating lips on baseboard wire-managing cover 290 to cover the corner of the floor and sidewall from view within the building.

The connection of the roof extrusion 333 to a top of the sidewall extrusion 334 includes features very similar to or identical to features 281–290. To avoid redundant and duplicative discussions, these features on roof extrusion 333 and at a top of sidewall extrusion 334 are identified by the same numbers, but with the addition of the letter "A."

FIGS. 30 and 31 disclose an alternative arrangement of extruders and corresponding process for joining together the extruded segments of FIG. 29C in a single process to form a building. Extruders 330 are connected to extruding dies 331 for manufacturing wall sections 332–335. The extruding dies 331 include funnel-shaped manifold transition dies 337 and profile dies 338. Raw material 336 is fed into extruders 330 and extruded through funnel-shaped manifold transition dies 337 to profile dies 338. The profile dies 338 form the molten material into the shape of extruded sections 332-335 and cool the material enough so that it is semi-self-supporting as the material exits the profile dies 338. A calibration device 339 receives the material from die 338 and holds the shape of the extrusion 32 as the inner portions of layers 44, 46, and 48 cool to a stable shape. Foam injectors can be provided at extruded dies 331 for injecting foam into the space within wall sections. Alternatively, the foam can be injected into the profile at a later step. Conveyors 341 are provided to assist in pulling the extruded wall sections 332–335 from the extruding dies 331. The wall sections are sized and further cooled along the initial section of conveyor 341. The sections 332–335 are gradually brought together with the assistance of rollers 343. The interconnection of the wall sections 332–335 can be accomplished by frictional or mechanical assembly and/or by adhesive. Once the connections are sufficiently secured or cured, a cutoff 344 is used to cut the one-piece extrusion 32 to a desired length. It is contemplated that the extrusion 32 can then be outfitted with cabinets, fixtures, wiring, utilities, and all components typically installed in modular homes that are constructed at a manufacturing site for later shipment to an installation/construction site.

Thus, a plurality of building structures are provided including one-piece and multi-piece tubular extrusions which are a "user friendly" product that simulates conventional wood frame housing, but which provides advantages of permanent color, moisture resistance, low air infiltration, high energy efficiency, and dramatically lower cost. The extruded home is capable of high volume mass production, but allows custom manufacture with high quality product. The wall construction includes inner and outer layers of structural polymeric materials bonded with rigid foam, which allows fabrication of an extrusion having flanges and other structural members specifically adapted to allow transportation of the building structure, attachment of the building structure to a foundation, and assembly of secondary parts to the building structure. In another aspect, a tubular extrusion providing living quarters is connected to an inverted U-shaped extrusion forming a garage for an automobile, which components are interconnected by an extruded breezeway structure.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A building structure comprising:

a geometrically-shaped elongated structure having a constant transverse cross section including a floor, a roof, and opposing sidewalls; each of the floor, the roof, and the opposing sidewalls being one piece, unitary, tubular polymeric extruded sections that are seamless along the length and width thereof with spaced apart inner and outer stiff layers and reinforcement walls interconnecting and reinforcing the inner and outer stiff layers, the foam bonding to the inner and outer stiff layers such that said inner and outer stiff layers carry loads and form a stressed skin structure having excellent strength and physical properties so that the opposing sidewalls and roof pass building code regulations and laws relating to residential buildings and so that the floor supports at least two adults standing thereon at a location between two other supported locations, said walls forming substantially the sole structural support for said roof with said building structure free of elongated upright structural members; and the floor including a plurality of webs integrally formed with the inner and outer stiff layers and extending therebetween at an angle to define, in cross section, a plurality of integrally formed, side-by-side, triangularly shaped elongated tube sections providing bending strength in the floor.

2. The building structure defined in claim 1 wherein the inner and outer layers are each at least about one eighth of an inch thick.

3. The building structure defined in claim 2 wherein the inner and outer layers and the reinforcement webs are prefabricated and form a rigid structural member, the foam material serving to further rigidify the rigid structural member and also increasing insulative properties of the structure.

4. The building structure defined in claim 3 wherein the floor, the roof, and the opposing sidewalls are each separately extruded one-piece extrusions that are rigidly secured together at abutting edges to form an integral building structure having a generally horizontal floor surface and generally vertical sidewall surfaces.

5. The building structure defined in claim 4 wherein the abutting edges each include a notch for guiding the abutting edges together and a connector for securing the abutting edges together.

6. The building structure defined in claim 5 wherein the abutting edges include a first flange, and the connector includes a mechanical fastener engaging the first flange to permanently secure the abutting edges together.

7. The building structure defined in claim 6 wherein the abutting edges include a second flange and a friction-type connector engaging the second flange to temporarily secure the abutting edges together.

8. The building structure defined in claim 7 wherein adhesive is applied at the abutting edges to secure the abutting edges together.

9. The building structure defined in claim 1 wherein the floor, the roof, and the opposing sidewalls are each separately extruded one-piece extrusions that are rigidly secured together at abutting edges to form an integral building structure having a generally horizontal floor surface and generally vertical sidewall surfaces.

10. A stressed skin structural member having a size, shape, and physical properties sufficient to act as a unitary, complete structural building wall in a residential housing construction comprising:

a large elongated polymeric extrusion having a length and a constant cross section, the extrusion including spaced apart inner and outer stiff layers and reinforcement webs interconnecting and reinforcing the stiff layers, the stiff layers and webs each having a thickness of at least about one-eighth of an inch, said extrusion having a unitary, seamless construction;

foam material filling spaces between and adhering to the inner and outer stiff layers such that said inner and outer stiff layers carry loads to form the stressed skin structural member having excellent strength and physical properties; and the stressed skin structural member having a main portion at least about two-inches thick, and a height at least as great as that of a standard single story house, and a length of at least about forty feet so that the structural member forms a complete wall of a room when incorporated into a building structure with the length of the extrusion extending horizontally, the stressed skin structural member including an integral elongated tubular portion forming a lower edge of the stressed skin structural member, the tubular portion having a horizontal dimension greater than the main portion and defining a ledge extending orthogonal to the inner layer to support a floor of building structure.

11. The stressed skin structural member defined in claim 10 wherein the outer stiff layer has a longitudinally extending pattern thereon that provides an appearance of vinyl siding when the extrusion is positioned horizontally.

12. The stressed skin structural member defined in claim 11 wherein the reinforcement webs extend perpendicularly to the inner layer.

13. The stressed skin structural member defined in claim 12 wherein the extrusion includes a bottom edge with an attachment flange thereon shaped to mateably engage a mating structural component to form one of a floor-to-wall corner and a wall-to-ceiling corner of a building room.

14. A building comprising a roof structure, a floor, and an opposing pair of sidewalls supporting the roof structure over the floor, the sidewalls each having a main structural and load bearing part incorporating the stressed skin structural member defined in claim 10.

15. The building defined in claim 14 wherein the stressed skin structural members substantially provide the sole support for the roof structure.

16. A one-piece unitary building structure comprising:

a unitary, geometrically-shaped, elongated structure having constant transverse cross section including a floor, a roof, and opposing sidewalls; each of the floor, the roof, and the opposing sidewalls formed integrally with one another to form the one-piece building structure;

each of the floor, the roof, and the opposing sidewalls being tubular polymeric extruded sections with spaced-apart inner and outer stiff layers defining a cavity therebetween; and foam material filling the cavity between the inner and outer stiff layers, the foam bonding to the inner and outer stiff layers such that said inner and outer stiff layers carry loads, thereby providing sufficient strength to meet building code regulations.

* * * * *